US011845164B2

(12) United States Patent
Dennes et al.

(10) Patent No.: US 11,845,164 B2
(45) Date of Patent: Dec. 19, 2023

(54) IMPACT DRIVER HAVING INDUCTOR AND INTERNAL MASS

(71) Applicant: International Business Machines Corporation, Armonk, NY (US)

(72) Inventors: Albert Dennes, Tucson, AZ (US); Adam Mullenbach, Tucson, AZ (US); Junfeng Xu, Tucson, AZ (US); Gregory Michael Ketterer, Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 205 days.

(21) Appl. No.: 17/319,928

(22) Filed: May 13, 2021

(65) Prior Publication Data

US 2022/0362911 A1 Nov. 17, 2022

(51) Int. Cl.
*B25B 21/00* (2006.01)
*B25B 21/02* (2006.01)

(52) U.S. Cl.
CPC ..... *B25B 21/02* (2013.01); *B25B 21/002* (2013.01)

(58) Field of Classification Search
CPC ..... B25B 21/00; B25B 21/02; B25B 21/002; B25B 21/004; B25B 21/008
See application file for complete search history.

(56) References Cited

U.S. PATENT DOCUMENTS

| | | | | |
|---|---|---|---|---|
| 6,536,536 | B1 * | 3/2003 | Gass | B25F 5/021 173/171 |
| 7,503,467 | B1 | 3/2009 | Swift | |
| 9,956,673 | B2 | 5/2018 | Yokoyama et al. | |
| 10,478,950 | B2 * | 11/2019 | Nagasaka | B25F 5/02 |
| 2005/0205273 | A1 | 9/2005 | Mu et al. | |
| 2010/0025063 | A1 | 2/2010 | Kuhnapfel et al. | |
| 2013/0186668 | A1 | 7/2013 | Hakenholt et al. | |
| 2015/0021062 | A1 * | 1/2015 | Sekino | B25B 23/14 173/183 |
| 2019/0030691 | A1 | 1/2019 | Koppenhoefer et al. | |
| 2020/0112283 | A1 | 4/2020 | Mahot | |
| 2020/0223256 | A1 * | 7/2020 | Paoli | B25B 23/1453 |
| 2022/0362911 | A1 * | 11/2022 | Dennes | B25B 21/02 |
| 2023/0086452 | A1 * | 3/2023 | Fan | B25B 21/00 173/176 |

FOREIGN PATENT DOCUMENTS

EP 2072191 A1 6/2009

* cited by examiner

*Primary Examiner* — Lee D Wilson
(74) *Attorney, Agent, or Firm* — Zilka-Kotab, P.C.

(57) ABSTRACT

An impact driver, in accordance with one embodiment, includes a rotatable shaft, and a rotating driver mechanism configured to rotate the shaft. A first mass is positioned to selectively strike the rotating driver mechanism for inducing a rotation of the shaft in a first direction. A first inductor is positioned to accelerate the first mass toward the rotating driver mechanism. A computer-implemented method, in accordance with one embodiment, includes repeatedly activating a first inductor for repeatedly accelerating a first mass toward a rotating driver mechanism to selectively strike the rotating driver mechanism for inducing a rotation of a shaft in a first direction. In response to receiving an indication that rotation of the shaft is detected, the repeated activation is terminated.

20 Claims, 9 Drawing Sheets

IMPACT DRIVER HAVING INDUCTOR AND INTERNAL MASS

BACKGROUND

The present invention relates to impact drivers, and more specifically, this invention relates to an impact driver using an inductor and internal mass.

Existing compact angle impact wrenches have small parts that are in constant movement/engagement. These parts can break, become contaminated with outside elements or lose lubrication over time, thereby inhibiting impact power. The amount of power generated by the impact is also determined by the size of the parts, which can make the tool larger and inconvenient in tighter spaces.

There are many different impact wrench designs including pin clutch, rocking dog clutch, double dog clutch, two-jaw clutch, twin lobe clutch, twin hammer clutch, triple lobe clutch and others.

SUMMARY

An impact driver, in accordance with one embodiment, includes a rotatable shaft, and a rotating driver mechanism configured to rotate the shaft. A first mass is positioned to selectively strike the rotating driver mechanism for inducing a rotation of the shaft in a first direction. A first inductor is positioned to accelerate the first mass toward the rotating driver mechanism.

A computer-implemented method, in accordance with one embodiment, includes repeatedly activating a first inductor for repeatedly accelerating a first mass toward a rotating driver mechanism to selectively strike the rotating driver mechanism for inducing a rotation of a shaft in a first direction. In response to receiving an indication that rotation of the shaft is detected, the repeated activation is terminated.

A computer program product for controlling operation of an impact driver includes a computer readable storage medium having program instructions embodied therewith, the program instructions executable by a computer to cause the computer to perform the foregoing method.

Other aspects and embodiments of the present invention will become apparent from the following detailed description, which, when taken in conjunction with the drawings, illustrate by way of example the principles of the invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following description discloses several preferred embodiments of an impact driver, such as an impact wrench, along with methods and computer program products for operating said impact driver.

Various embodiments are able to provide impact force within a small space. This is accomplished by utilizing a long impact driver housing having an inductor therealong. The inductor is used to drive an internal mass up and down within the length of the impact driver, generating acceleration and thereby transferring that energy as impact to drive a rotatable shaft, which may be configured to receive conventional socket heads, for example. The impact creates torque on a fastener for loosening and/or tightening.

In one general embodiment, an impact driver includes a rotatable shaft, and a rotating driver mechanism configured to rotate the shaft. A first mass is positioned to selectively strike the rotating driver mechanism for inducing a rotation of the shaft in a first direction. A first inductor is positioned to accelerate the first mass toward the rotating driver mechanism.

In another general embodiment, a computer-implemented method includes repeatedly activating a first inductor for repeatedly accelerating a first mass toward a rotating driver mechanism to selectively strike the rotating driver mechanism for inducing a rotation of a shaft in a first direction. In response to receiving an indication that rotation of the shaft is detected, the repeated activation is terminated.

In another general embodiment, computer program product for controlling operation of an impact driver includes a computer readable storage medium having program instructions embodied therewith, the program instructions executable by a computer to cause the computer to perform the foregoing method.

Impact Driver System

Figure 1:
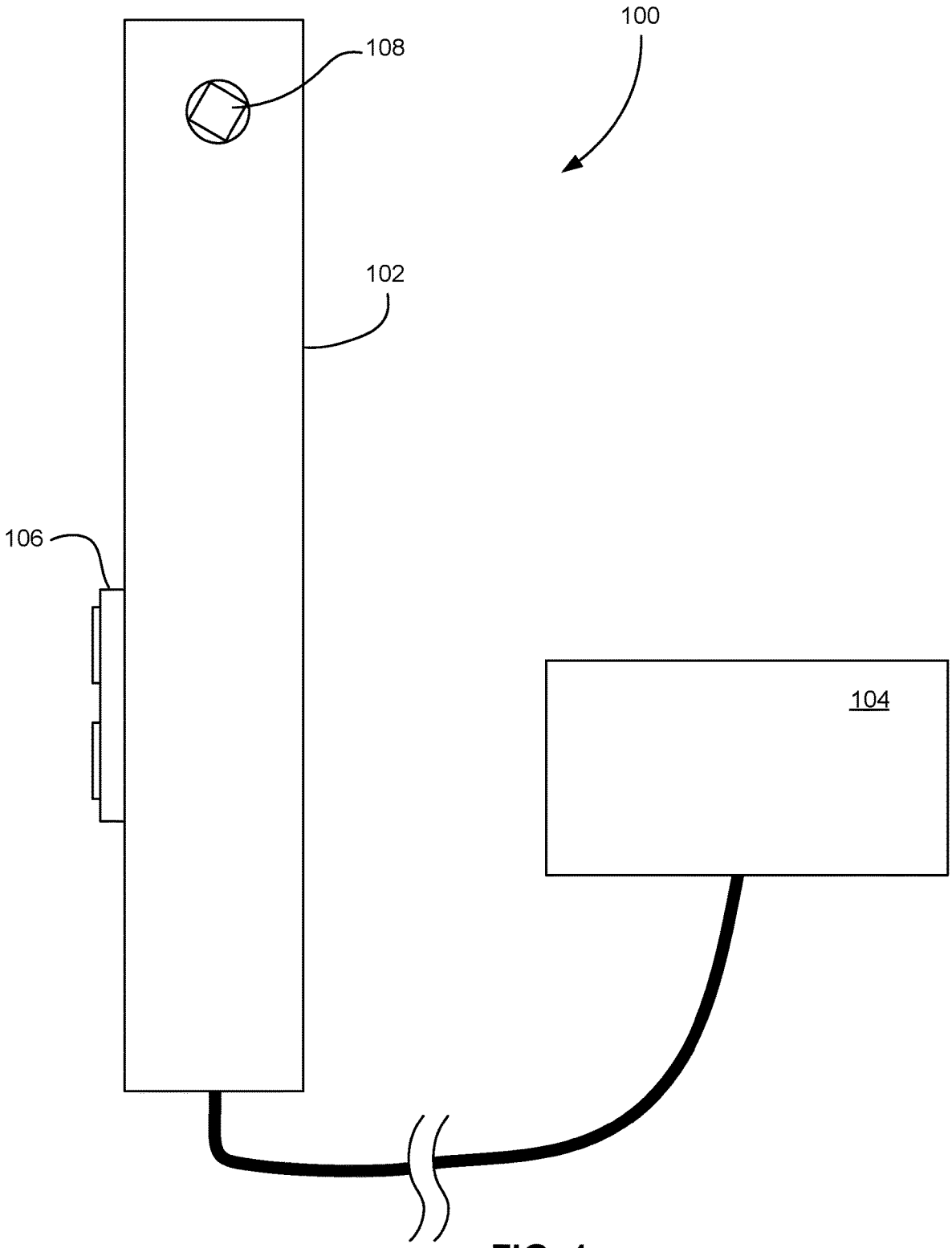
FIG. 1 is a system diagram of an impact driver system, in accordance with one embodiment of the present invention.

FIG. 1 depicts an impact driver system 100, in accordance with one embodiment. As an option, the present system 100 may be implemented in conjunction with features from any other embodiment listed herein, such as those described with reference to the other FIGS. Of course, however, such system 100 and others presented herein may be used in various applications and/or in permutations which may or may not be specifically described in the illustrative embodiments listed herein. Further, the system 100 presented herein may be used in any desired environment.

As shown, the system 100 includes an impact driver 102 coupled to a computer 104 that is configured to control operation of the impact driver 102.

The computer 104 may be positioned anywhere desired relative to the impact driver 102. For example, the computer 104 may be external to the impact driver 102 as shown in FIG. 1, may be internal to the housing of the impact driver 102 (e.g., in the form of a chip, circuit board, etc.), may be coupled externally to the housing of the impact driver 102, or some combination thereof. The computer 104 may be a controller, chip, personal computer, handheld device, or other computing circuit of any suitable kind. The computer 104 preferably controls start/stop of energy flow to each inductor tube (depending on fastening mode "direction").

A control 106 is present to receive operating commands from a user, e.g., to provide a signal that causes the impact driver 102 to operate in a desired mode of operation, such as loosen or tighten. For example, the control 106 may provide signals to the computer 104, which in turn causes the computer 104 to control operation of the impact driver 102. The control 106 may be of conventional construction, such as a button-operated switch, sliding switch, rocker switch, button panel, etc.

In operation, a rotatable shaft 108 is caused to rotate, at least in part from impacts from an internal mass, as will be described in more detail below. The rotatable shaft 108 may be used to rotate any desired object, such as a conventional socket wrench, a screwdriver head, etc. In some approaches, the impact driver 102 functions as an impact wrench.

Figure 2:
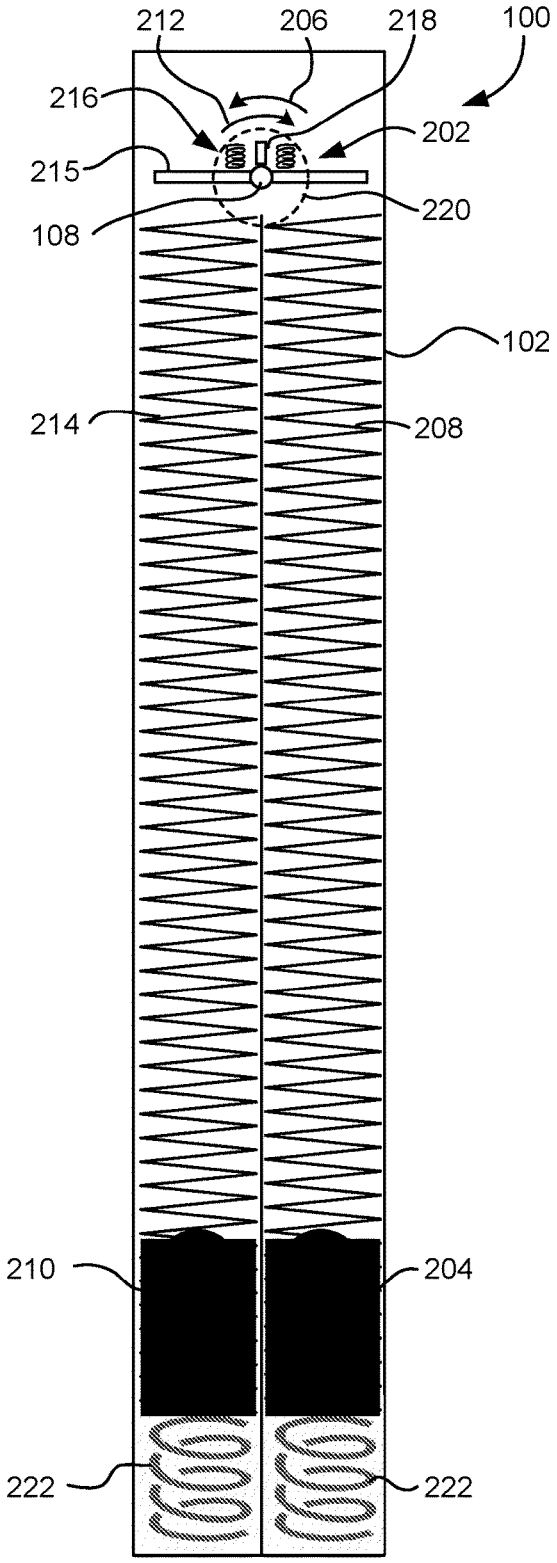
FIG. 2 is a diagram of inner components of the impact driver system, in accordance with one embodiment of the present invention.

Referring to FIG. 2, a representation of basic internal components of the impact driver 102 are depicted. A rotating driver mechanism 202 is configured to rotate the rotatable shaft 108. A first mass 204 is positioned to selectively strike the rotating driver mechanism 202 for inducing a rotation of the shaft 108 in a first direction 206. A first inductor 208 is positioned to accelerate the first mass 204 toward the rotating driver mechanism 202.

For a unidirectional impact driver 102, only one mass 204 may be present, along with the foregoing basic components.

However, in preferred approaches, the impact driver 102 is bidirectional. Accordingly, as shown, a second mass 210 is positioned to selectively strike the rotating driver mechanism 202 for inducing a rotation of the shaft 108 in a second direction 212 that is opposite the first direction 206. A second inductor 214 is positioned to accelerate the second mass 210 toward the rotating driver mechanism 202.

The mass 204, 210 may have any desired configuration and/or composition that would become apparent to one skilled in the art upon reading the present disclosure. Heavier metals and alloys that are compatible with the inductor system, and that can withstand the repeated impacts with minimal disfigurement, are preferred.

Each mass 204, 210 may reside in a respective induction tube that is used to generate mass acceleration both upward and downward, e.g., for both fastening and unfastening directions 212, 206. Each inductor tube may be of conventional design, with minor modifications, if needed, to be integrated into the instant system 100. A cross sectional shape of each tube, taken perpendicular to the longitudinal axis thereof may have any shape, e.g., round, square, oval-shaped, etc.

The inductor strength is generally proportional to the amount of current applied and number of wraps. Preferably, the power level is applied in stages throughout the mass travel path to continue accelerating the mass 204, 210.

The torque breakaway strength of the system 100, e.g., removing a stuck fastener, is generally a function of the weight of the mass, inductor strength (acceleration rate of mass), spring rate, and length of travel of the mass.

The rotating driver mechanism 202 may have any desired configuration that would become apparent to one skilled in the art upon reading the present disclosure. In one contemplated approach, mechanical levers 215, which the masses 204, 210 strike, are used to transfer force from the masses 204, 210 into rotary force enacted upon the shaft 108 for impact type strength.

Preferably, a centering mechanism 216 is configured to reset the rotating driver mechanism 202 to about its starting position after each impact of a mass 204, 210 thereupon. The centering mechanism 216 may have any desired configuration that would become apparent to one skilled in the art upon reading the present disclosure. In one exemplary approach, springs are used.

A rotation detector 218 may be present to detect rotation of the shaft 108 or equivalently some portion of the rotating driver mechanism 202. For example, in a fastener-loosening scenario, once the impacts break the fastener free (breakaway torque has been reached), the shaft 108 will rotate with the fastener under the force of the impact by the first mass 204. The rotation detector 218 may be coupled to the computer 104 to induce any of a variety of actions upon detecting rotation. For example, computer 104 may stop the impacting upon receiving a signal indicative of rotation of the shaft 108. The computer 104 preferably monitors the rotation detector 218.

In a preferred approach, the computer 104 may stop the impacting and cause a secondary driver 220 to rotate the shaft 108 upon receiving a signal indicative of rotation of the shaft 108. Note that the rotation detector 218 may be configured to indicate rotation only after a predetermined amount of rotation is detected, e.g., to prevent indication of rotation from mere wiggling of the impact driver 102.

The rotation detector 218 may be of any configuration that would become apparent to one skilled in the art upon being apprised of the present disclosure. In one approach, the rotation detector 218 is a gyroscope attached to the shaft 108. In another approach, the rotation detector 218 is optical, e.g., detects a change in color when a stripe or groove on the shaft 108 moves into or out of the field of view of the rotation detector 218. In another approach, the rotation detector 218 is magnetic, detecting presence or absence of a magnetic field upon rotation of the shaft 108.

In another approach, the rotation detector 218 is integrated in the computer 104, and detects back electromotive force from the secondary driver 220 when the shaft 108 rotates.

As noted above, a secondary driver 220 may be present to rotate the shaft 108. The secondary driver 220 may be any desired driver. Examples include an electric motor coupled and/or geared to the shaft 108, an inductor-driven driver coupled and/or geared to the shaft 108, etc.

Electrical wiring of any desired type that would become apparent to one skilled in the art upon reading the present disclosure is preferably present to provide electrical energy and/or signals to the inductor system, rotation detector 218, secondary driver 220, computer 104, etc. Moreover, power to drive the impact driver system 100 may be provided via power cord, battery, etc.

As also shown in FIG. 2, accelerator springs 222 of any suitable type may be present, and positioned to assist in accelerating the associated mass 204, 210 toward the rotating driver mechanism 202, as will be described in more detail below. The accelerator springs 222 may be metal coil springs, leaf springs, pneumatic springs, etc.

More details about various optional components and utility of the impact driver system 100 depicted in FIGS. 1 and 2 will become apparent upon reading the following exemplary mode of use.

Exemplary Operational Sequence

Now referring to FIGS. 3A-3D, a sequence of events is depicted to illustrate the impact driver system 100 in operation. The method sequence of events may be performed in accordance with the present invention in any of the environments depicted in FIGS. 1-2, among others, in various embodiments. Of course, more or fewer operations than those specifically described in FIGS. 3A-3D may be included in the sequence of events, as would be understood by one of skill in the art upon reading the present descriptions.

Each of the steps of the sequence of events may be performed by any suitable component of the operating environment. For example, in various embodiments, various ones of the events may be partially or entirely caused or performed by a computer, or some other device having one or more processors therein. The processor, e.g., processing circuit(s), chip(s), and/or module(s) implemented in hardware and/or software, and preferably having at least one hardware component may be utilized in any device to perform one or more events. Illustrative processors include, but are not limited to, a central processing unit (CPU), an application specific integrated circuit (ASIC), a field programmable gate array (FPGA), etc., combinations thereof, or any other suitable computing device known in the art.

Prior to the sequence, the impact driver system 100 may be unpowered and at rest, e.g., with components positioned as depicted in FIG. 2.

Assume the user wishes to rotate the shaft 108 in a counterclockwise direction (206 of FIG. 2), e.g., to loosen a fastener positioned behind the impact driver 102.

To begin the sequence, the impact driver system 100 is turned on, e.g., via a power switch, by the computer 104 upon detecting operation of the control 106, etc. The system 100 detects activation of a portion of the control 106 (e.g., press of a button), which is associated with a rotation of the shaft 108 in a counterclockwise direction. The computer 104 may control operation of the system 100, e.g., at least in part per instructions received via the control 106.

As an optional step, the inductor 208 may be activated in a polarity that urges the mass 204 toward the accelerator spring 222, to store potential energy.

Figure 3A:
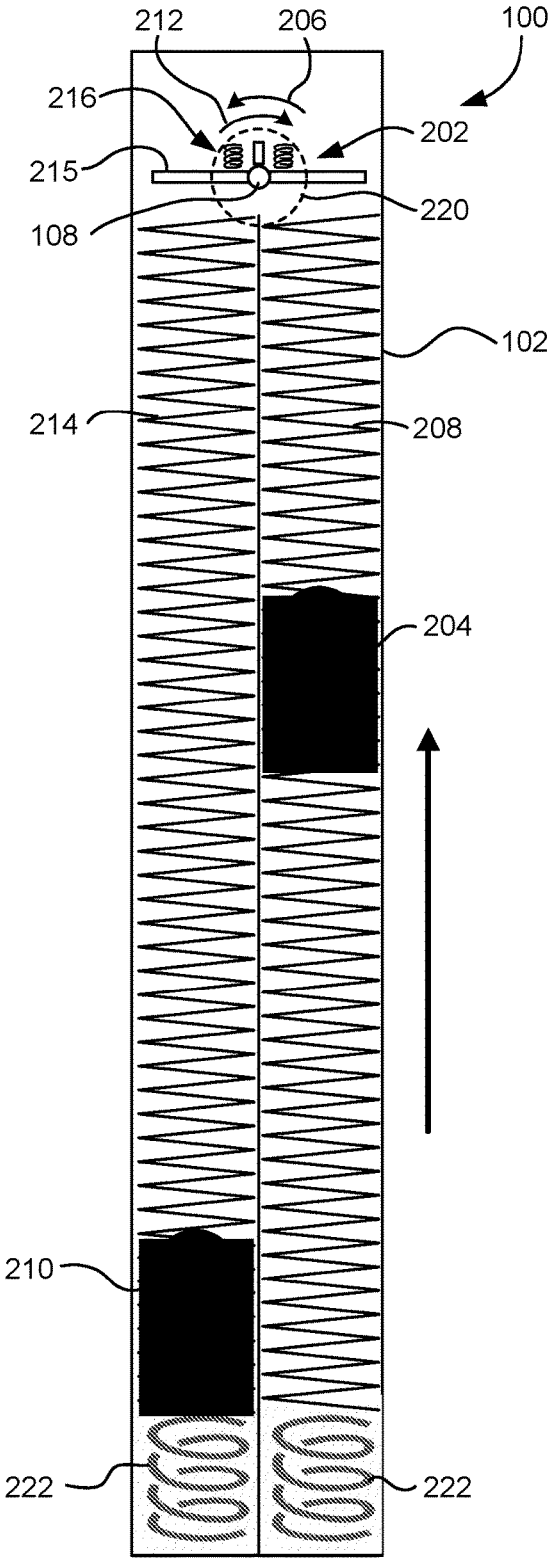
FIGS. 3A-3D are depictions of a sequence of events is depicted to illustrate the impact driver system in operation, in accordance with one embodiment of the present invention.

Referring to FIG. 3A, the inductor 208 is activated in a polarity that accelerates the mass 204 toward the rotating driver mechanism 202. If the optional step noted above was performed, the potential energy stored in the accelerator spring 222 is consumed to help drive the mass 204.

Figure 3B:
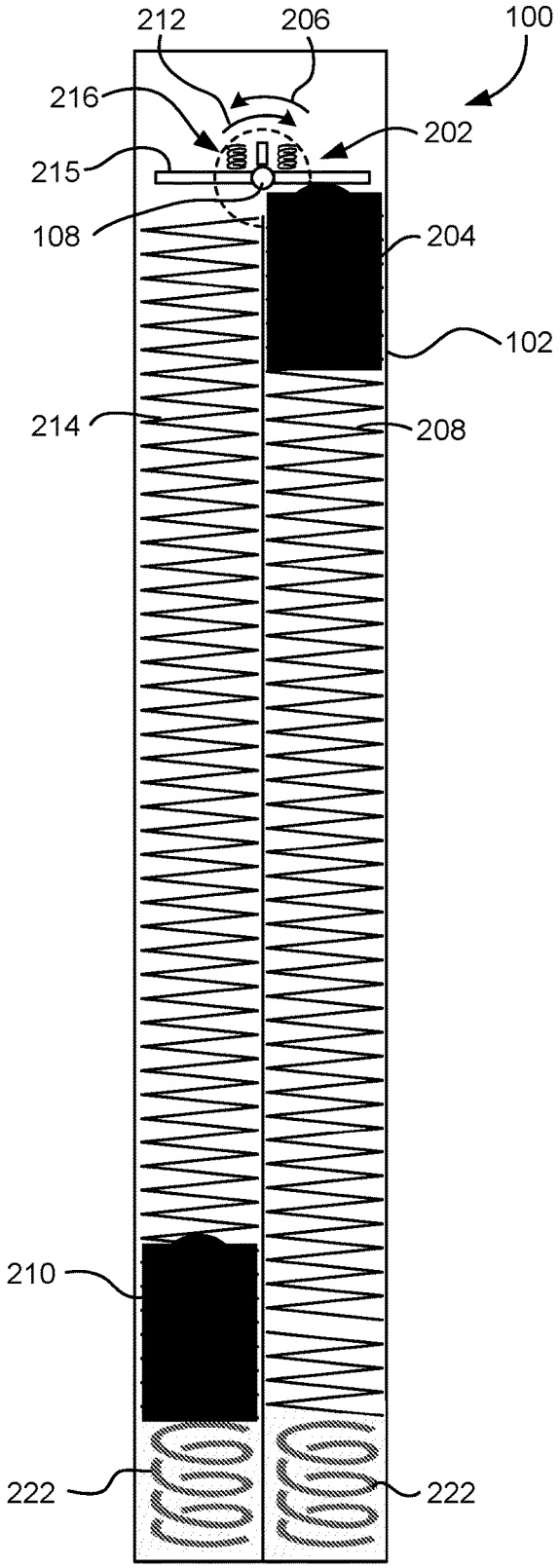

As shown in FIG. 3B, the mass 204 is accelerated along the inductor 208 to cause it to strike the rotating driver mechanism 202. This impact is translated as force to the shaft 108, which causes the driver to exhibit rotational force on the shaft 108. Where a socket head is coupled to the shaft 108, the impact is translated as rotational force to the socket head.

Note that the direction of travel of the mass 204 is about perpendicular to an axis of rotation of the shaft 108. Moreover, a travel path of the mass 204 is within a handle of the impact driver 102. This enables a more compact device.

Figure 3C:
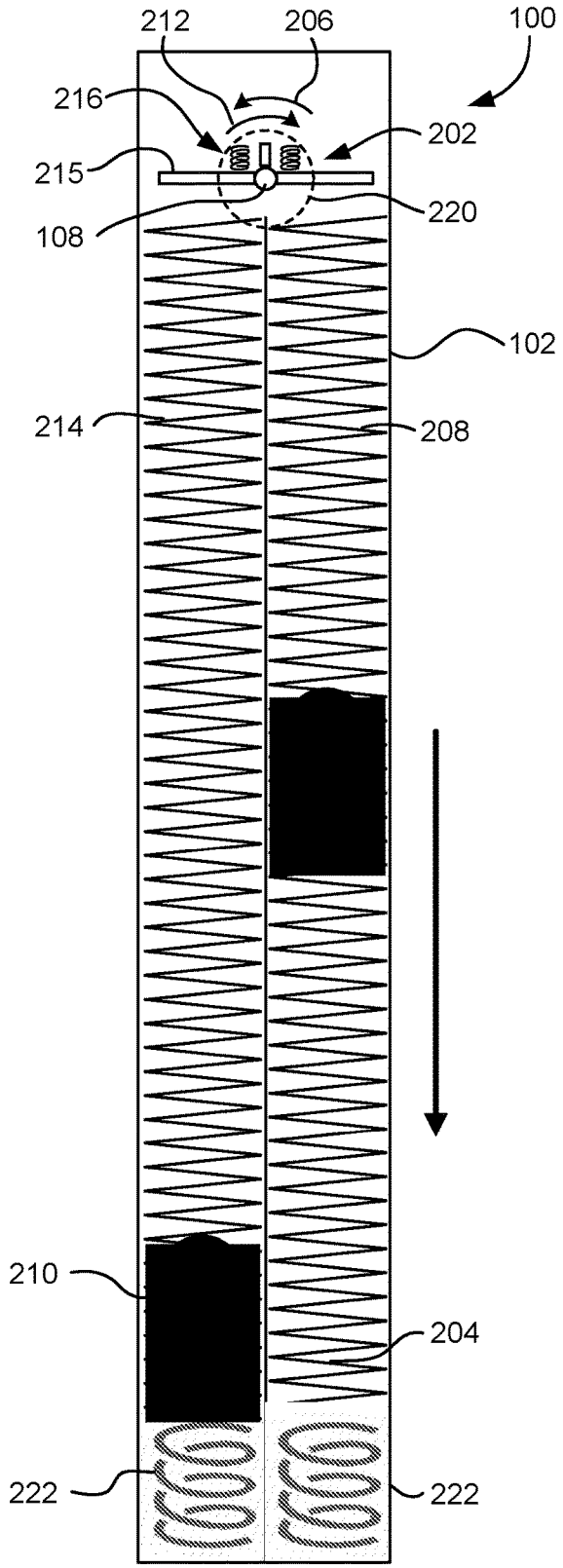

Referring to FIG. 3C, the polarity of the inductor 208 is switched to accelerate the mass 204 back through the inductor tube, away from the rotating driver mechanism 202. The rotating driver mechanism 202 is reset to its nominal starting position by the centering mechanism 216.

Figure 3D:
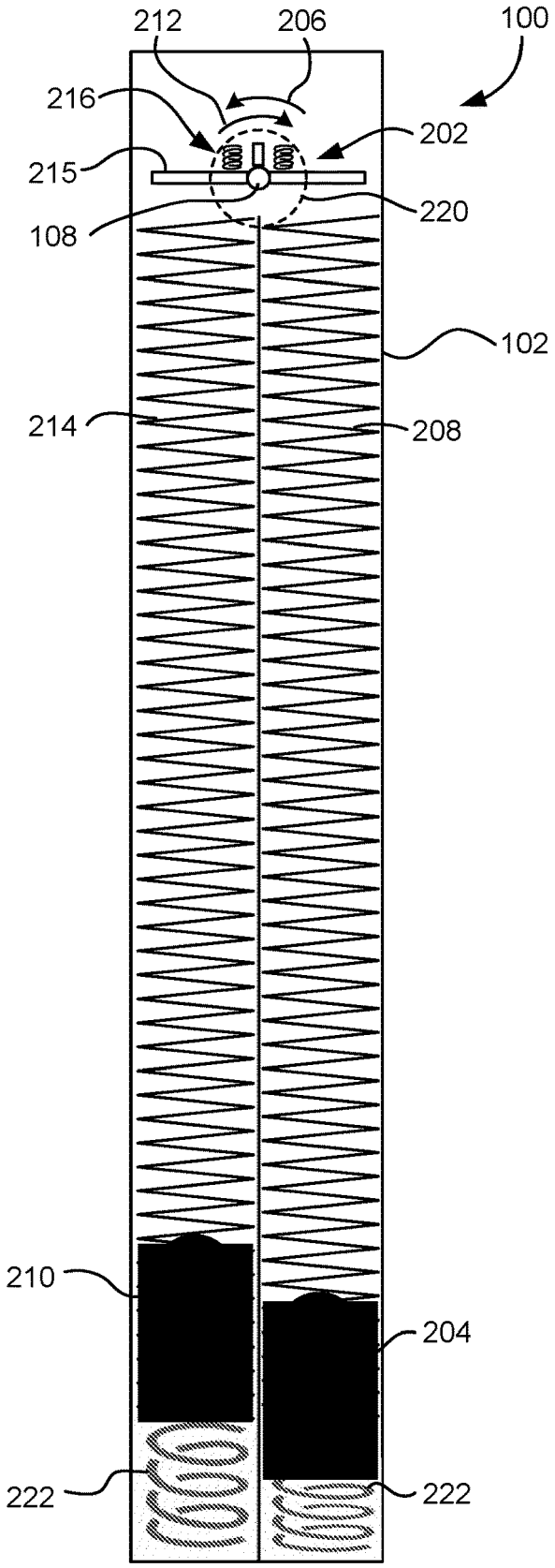

Referring to FIG. 3D, the mass 204 comes in contact with the accelerator spring 222 at the bottom of the inductor tube and compresses the accelerator spring down 222, thereby storing potential energy.

Then the polarity of the inductor 208 is switched again to accelerate the mass 204 toward the rotating driver mechanism 202 again for another cycle. The stored energy within the acceleration spring also transfers back into the acceleration of the mass 204, helping it accelerate. Preferably, the computer 104 is configured to alternate the polarity of a signal applied to the inductor 208 to alternatingly accelerate the mass 204 toward and away from the rotating driver mechanism 202.

This process may be repeated until the shaft 108 is detected to have rotated (e.g., indicative of a fastener having been "loosened"). At this point the inductor process is halted and the power driving the impact tool is now directed toward the secondary driver 220 to continue rotating the shaft 108, e.g., to continue loosening the fastener in the example.

Eventually the impact driver system 100 is turned off, e.g., by the user via the control 106, by the computer 104 after a period of time expires, etc.

Likewise, for rotating the shaft 108 in the opposite direction, e.g., to tighten a fastener, a sequence of events generally in reverse of those presented immediately above is performed using the other mass 210. In this case, the secondary driver 220 may first rotate the shaft 108 in the clockwise direction to quickly tighten the fastener. Then, upon detecting the shaft 108 ceasing to rotate, e.g., using the rotation detector 218, the other mass 210 is accelerated toward the rotating driver mechanism 202 repeatedly to create impact-induced rotation of the shaft 108. The number of cycles performed may be predetermined, may be unlimited until a user stops the sequence via the control 106, may continue until the rotation detector 218 detects no further impact-induced rotation of the shaft 108 (inferring the fastener has been sufficiently tightened), etc.

Figure 4:
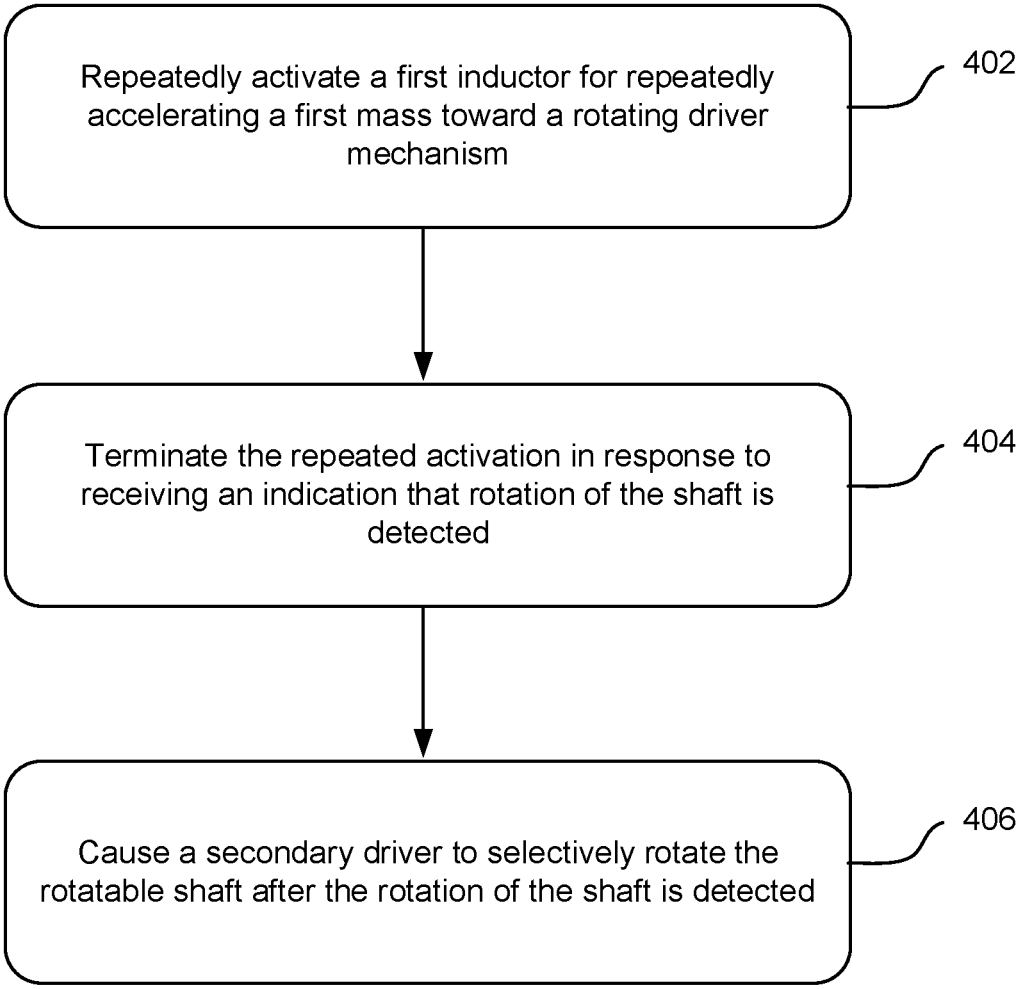
FIG. 4 is a flow diagram of a method, in accordance with one embodiment of the present invention.

Now referring to FIG. 4, a flowchart of a method 400 is shown according to one embodiment. The method 400 may be performed in accordance with the present invention in any of the environments depicted in FIGS. 1-3D, among others, in various embodiments. Of course, more or fewer operations than those specifically described in FIG. 4 may be included in method 400, as would be understood by one of skill in the art upon reading the present descriptions.

Each of the steps of the method 400 may be performed by any suitable component of the operating environment. For example, in various embodiments, the method 400 may be partially or entirely performed by the impact driver systems disclosed herein, or some other device having one or more processors therein. The processor, e.g., processing circuit(s), chip(s), and/or module(s) implemented in hardware and/or software, and preferably having at least one hardware component may be utilized in any device to perform one or more steps of the method 400. Illustrative processors include, but are not limited to, a central processing unit (CPU), an application specific integrated circuit (ASIC), a field programmable gate array (FPGA), etc., combinations thereof, or any other suitable computing device known in the art.

As shown in FIG. 4, method 400 may initiate with operation 402, where a first inductor is repeatedly activated for repeatedly accelerating a first mass toward a rotating driver mechanism to selectively strike the rotating driver mechanism for inducing a rotation of a shaft in a first direction. Preferably, a polarity of the first inductor is reversed between the activating operations for accelerating the first mass away from the rotating driver mechanism and toward an accelerator spring.

In operation 404, in response to receiving an indication that rotation of the shaft is detected, the repeated activation is terminated. As noted above, the indication may be received from a rotation detector.

In operation 406, a secondary driver is caused to selectively rotate the rotatable shaft sometime after the rotation of the shaft is detected. Note that in some approaches, the secondary driver may be activated during operation 402 to assist in achieving breakaway force and/or to take advantage of the burst of momentum provided upon an impact causing rotation e.g., when a fastener breaks free.

As noted above, the reverse process may also be performed, e.g., to tighten a fastener. For example, the secondary driver may be caused to selectively rotate the rotatable shaft to tighten the fastener as much as it can. Then, a second inductor is repeatedly activated for repeatedly accelerating a second mass toward the rotating driver mechanism to selectively strike the rotating driver mechanism for inducing a rotation of the shaft in a second direction that is opposite the first direction. When an indication that rotation of the shaft due to the impacts is no longer detected, indicating the fastener is now tight, the repeated activation of the second inductor is terminated.

Illustrative Embodiments

Figure 5B:
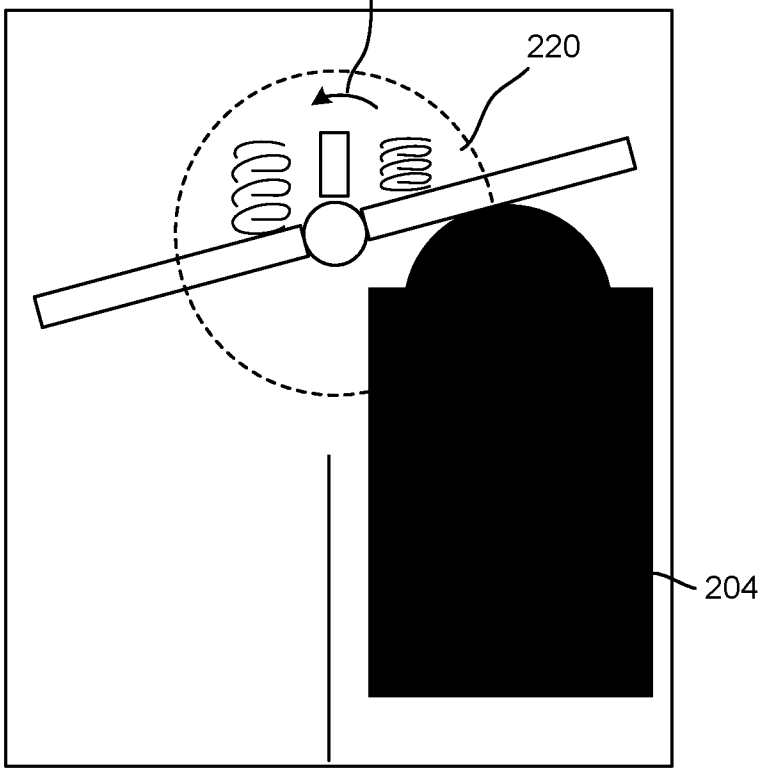
FIGS. 5A-5B depict operation of a rotating driver mechanism, in accordance with one embodiment.
Figure 5A:
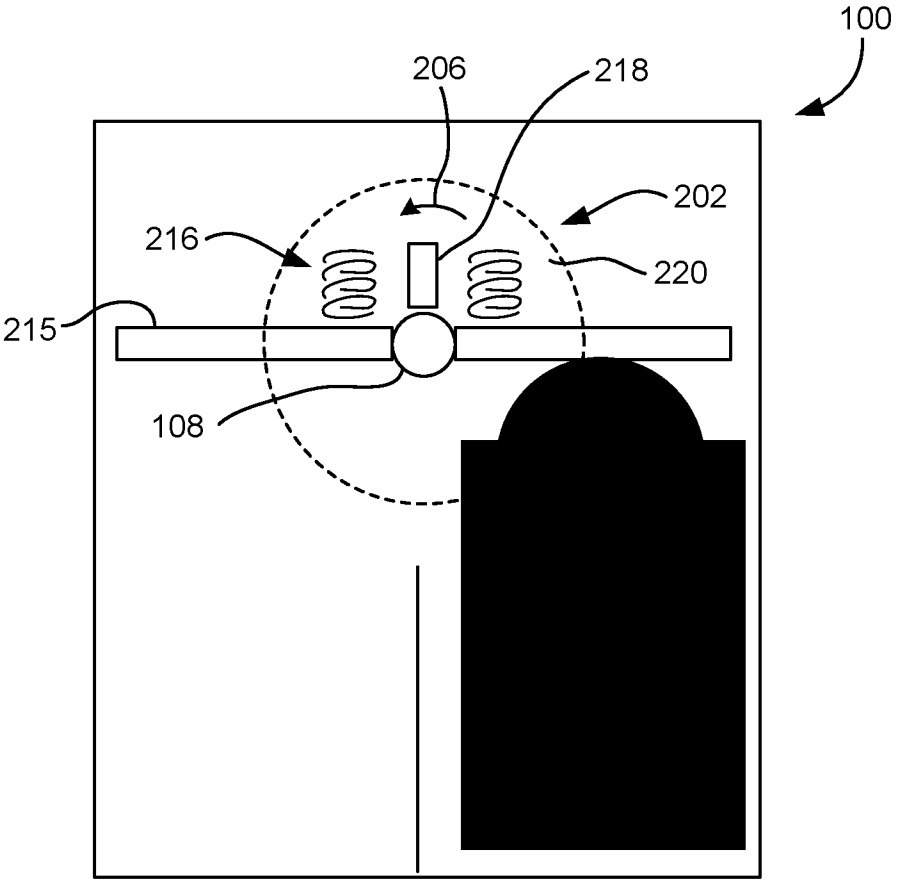

FIGS. 5A-5B depict operation of a rotating driver mechanism 202, in accordance with one embodiment. As an option, the present rotating driver mechanism 202 may be implemented in conjunction with features from any other embodiment listed herein, such as those described with reference to the other FIGS. Of course, however, such rotating driver mechanism 202 and others presented herein may be used in various applications and/or in permutations which may or may not be specifically described in the illustrative embodiments listed herein. Further, the rotating driver mechanism 202 presented herein may be used in any desired environment.

As shown in FIG. 5A, the energy from the moving mass 204 is converted to rotary force upon impact of the mass 204 with the lever 215 of the rotating driver mechanism 202 that drives the shaft 108.

Referring to FIG. 5B, after a number of acceleration cycles, break away torque is achieved (fastener is loosened) which causes the lever 215 to tilt, rotating the shaft 108.

A rotation detector 218 detects rotation of the shaft 108 and/or angle change of the lever 215, and sends a signal to the computer, which in turn activates the secondary driver 220 to continue removing the fastener, preferably at a higher speed and lower torque. Note that the force imparted on the shaft 108 by the final impact also provides an initial burst of acceleration to the shaft 108, which assists the secondary driver 220.

Figure 6A:
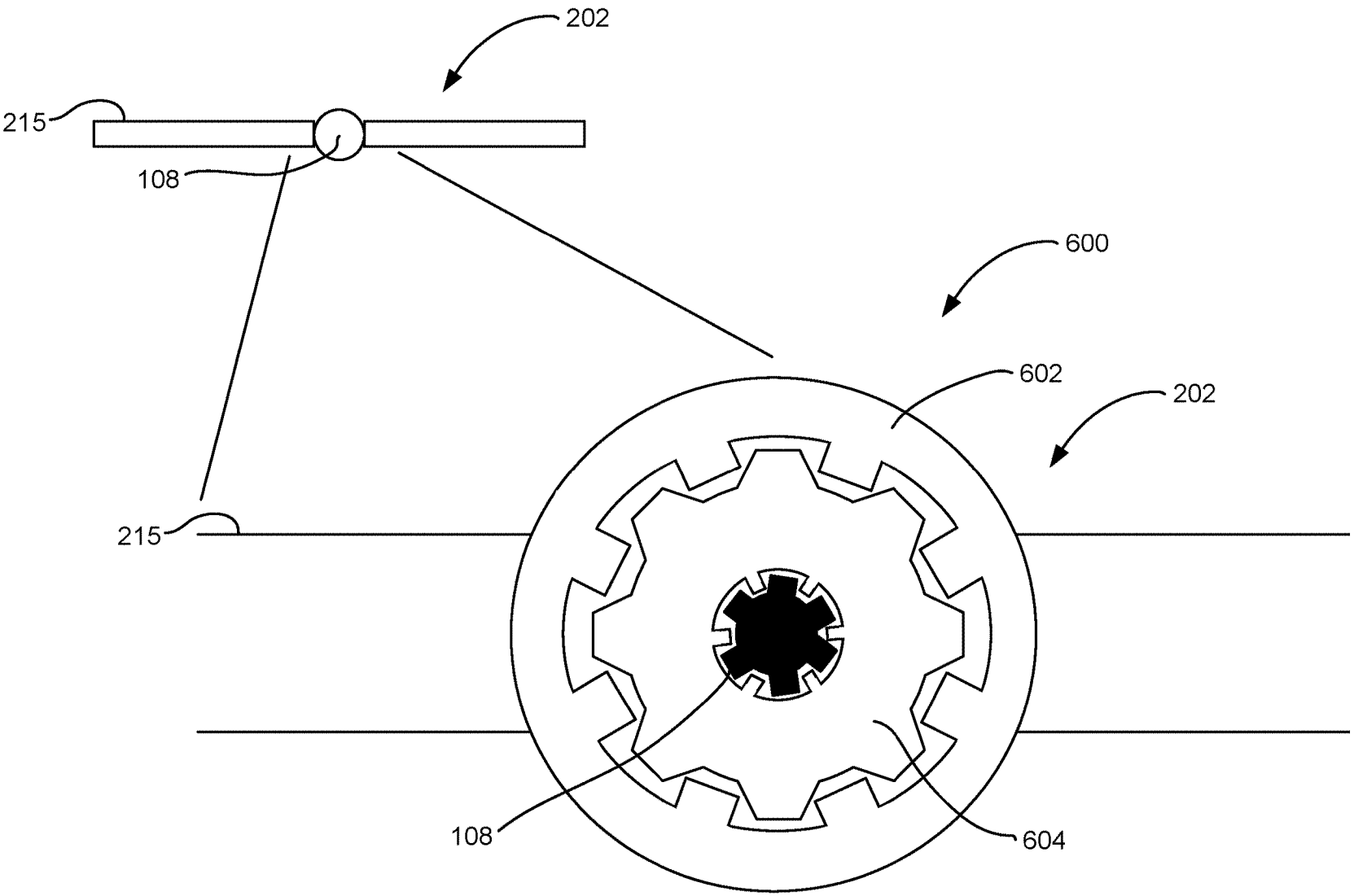
FIGS. 6A-6C depict operation of a gear selector mechanism for selectively engaging the rotating driver mechanism with the shaft, in accordance with one embodiment.
Figure 6C:
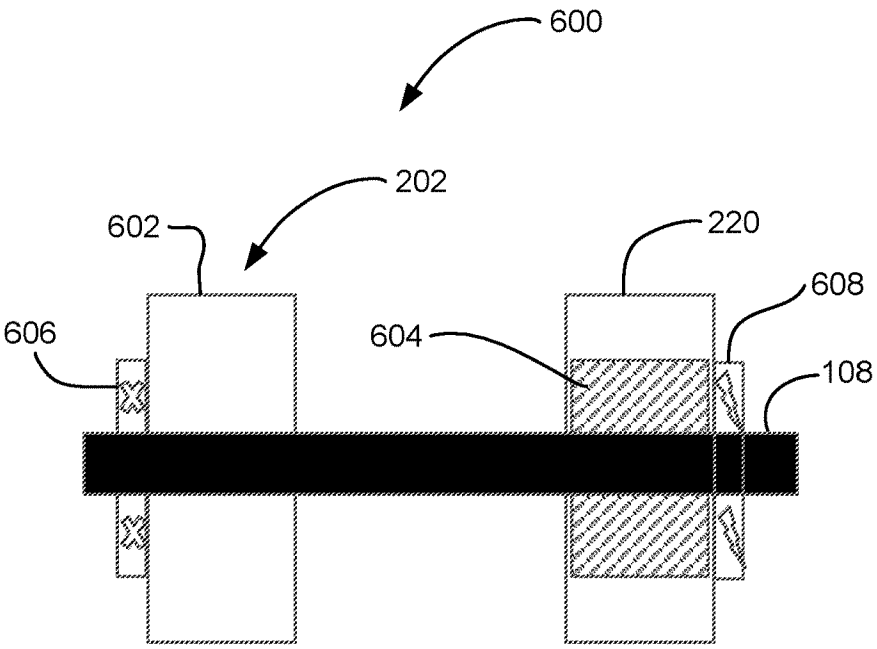
Figure 6B:
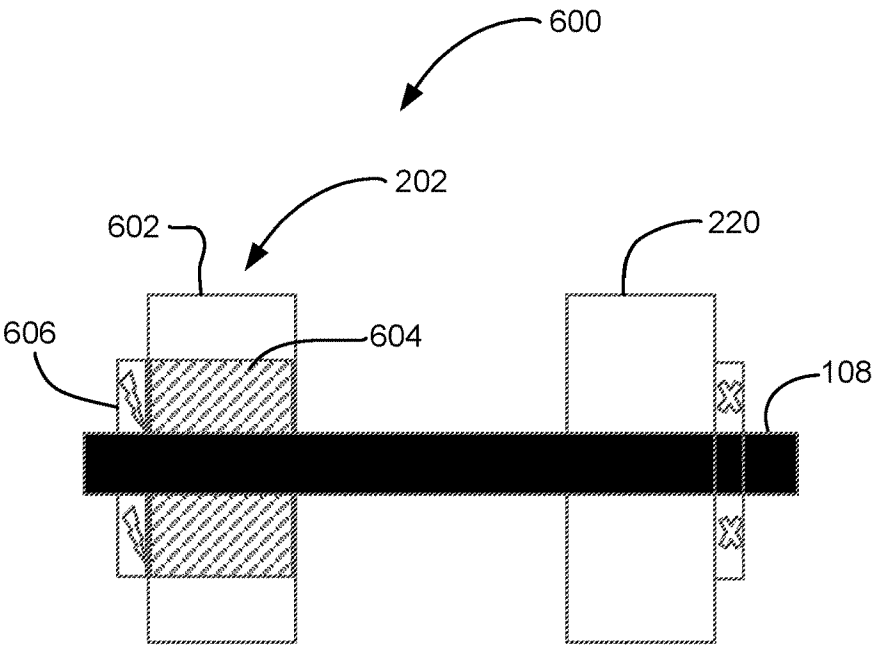

FIGS. 6A-6C depict operation of a gear selector mechanism 600 for selectively engaging the rotating driver mechanism 202 with the shaft 108, in accordance with one embodiment. As an option, the present gear selector mechanism 600 may be implemented in conjunction with features from any other embodiment listed herein, such as those described with reference to the other FIGS. Of course, however, such gear selector mechanism 600 and others presented herein may be used in various applications and/or in permutations which may or may not be specifically described in the illustrative embodiments listed herein. Further, the gear selector mechanism 600 presented herein may be used in any desired environment.

Referring to FIG. 6A, an end view of the gear selector mechanism 600 is shown in relation to the rotating driver mechanism 202, and in detail. As shown, the levers 215 are coupled to a sleeve 602 of the rotating driver mechanism 202. A gear selector 604 selectively couples the sleeve to the shaft 108.

Referring to FIGS. 6A-6C, the gear selector 604 preferably rides on the shaft 108, and is configured to slide back and forth along the shaft 108 to selectively engage/disengage at least the rotating driver mechanism 202 from the shaft 108, and preferably also the secondary driver 220 from the shaft 108, to transmit the forces generated to the shaft 108. The gear selector may be meshed with the shaft 108 at all times, in some approaches.

Preferably, if the rotating driver mechanism 202 is engaged, the secondary driver 220 is disengaged, and vice versa.

In some approaches, a synchronizer of conventional construction is implemented to allow more seamless/quick meshing of the gear selector 604 with the respective components.

Referring to the representational view of FIG. 6B, the gear selector 604 is engaged with the rotating driver mechanism 202. An electromagnet 606 may be used to pull and maintain the gear selector 604 into engagement with the rotating driver mechanism 202.

Referring to the representational view of FIG. 6C, upon reaching breakaway torque, a second electromagnet 608 is engaged (and the first electromagnet 606 is disengaged) to pull the gear selector 604 into engagement with the secondary driver 220. Accordingly, the magnetic assembly of the electromagnets 606, 608 may be used to position the gear selector between the rotating driver mechanism 202 and the secondary driver 220.

Figure 7:
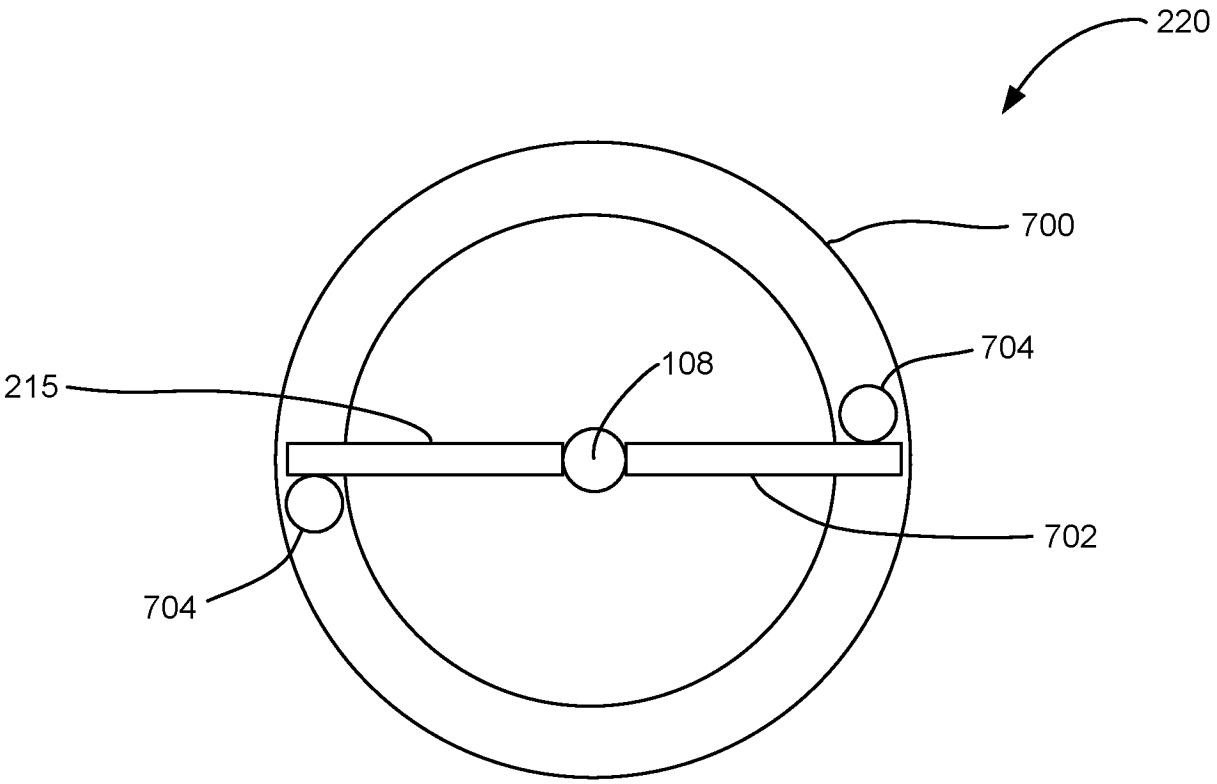
FIG. 7 is a diagram of an illustrative secondary driver having a circular induction system for driving a lever or multiple levers that rotates the shaft, in accordance with one embodiment.

FIG. 7 depicts an illustrative secondary driver 220 having a circular induction system 700 for driving a lever 702 or multiple levers 702 that rotates the shaft 108, in accordance with one embodiment. As an option, the present rotating secondary driver 220 may be implemented in conjunction with features from any other embodiment listed herein, such as those described with reference to the other FIGS. Of course, however, such rotating secondary driver 220 and others presented herein may be used in various applications and/or in permutations which may or may not be specifically described in the illustrative embodiments listed herein. Further, the rotating secondary driver 220 presented herein may be used in any desired environment.

The circular induction system 700 may provide higher speed/lower torque rotation force, and is especially useful to continue rotation of the shaft 108 after breakaway torque is achieved. As above, the initial burst of acceleration derived from reaching the breakaway force may assist the secondary driver 220 as it begins to rotate the shaft 108.

This circular induction system 700 may be used instead of a conventional electrical motor design since it allows the driving mechanism and parts to be more compact and maintain a slender profile than state of the art products currently available.

Note that the secondary driver 220 having a circular induction system 700 can work with or without a gear selector. Accordingly, in some aspects, the circular induction system 700 is permanently affixed to the shaft 108.

As shown, the secondary driver 220 includes one or more levers 702 that transmit thrust force from one or more driven induction masses 704 to rotational force enacted on the shaft 108 to rotate the shaft 108. The circular induction system 700 drives the masses 704 to provide fast acceleration (high speed) low torque force on the shaft 108. Each mass 704 is preferably affixed to a respective lever 702.

There has thus been described a powerful impact driver having, in some approaches, a minimal amount of small moving parts, thereby increasing the durability and reliability of this type of impact tool. The various embodiments described herein use a vastly different design that sets it apart from any other existing impact design. Due to the nature of the present design, the strength of the impacting is generally determined by the length of the tool rather than the width thereby allowing our tool to provide more torque than other tools on the market while also being applicable for use in tight locations.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Moreover, a system according to various embodiments may include a processor and logic integrated with and/or executable by the processor, the logic being configured to perform one or more of the process steps recited herein. The processor may be of any configuration as described herein, such as a discrete processor or a processing circuit that includes many components such as processing hardware, memory, I/O interfaces, etc. By integrated with, what is meant is that the processor has logic embedded therewith as hardware logic, such as an application specific integrated circuit (ASIC), a FPGA, etc. By executable by the processor, what is meant is that the logic is hardware logic; software logic such as firmware, part of an operating system, part of an application program; etc., or some combination of hardware and software logic that is accessible by the processor and configured to cause the processor to perform some functionality upon execution by the processor. Software logic may be stored on local and/or remote memory of any memory type, as known in the art. Any processor known in the art may be used, such as a software processor module and/or a hardware processor such as an ASIC, a FPGA, a central processing unit (CPU), an integrated circuit (IC), a graphics processing unit (GPU), etc.

It will be clear that the various features of the foregoing systems and/or methodologies may be combined in any way, creating a plurality of combinations from the descriptions presented above.

It will be further appreciated that embodiments of the present invention may be provided in the form of a service deployed on behalf of a customer to offer service on demand.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An impact driver, comprising:

a rotatable shaft;

a rotating driver mechanism configured to rotate the shaft;

a first mass positioned to selectively strike the rotating driver mechanism for inducing a rotation of the shaft in a first direction; and a first inductor positioned to accelerate the first mass toward the rotating driver mechanism.

2. The impact driver of claim 1, comprising:

a second mass positioned to selectively strike the rotating driver mechanism for inducing a rotation of the shaft in a second direction that is opposite the first direction; and a second inductor positioned to accelerate the second mass toward the rotating driver mechanism.

3. The impact driver of claim 1, comprising a centering mechanism configured to reset the rotating driver mechanism to about a starting position after each impact of the first mass thereupon.

4. An impact driver, comprising:

a rotatable shaft;

a rotating driver mechanism configured to rotate the shaft;

a first mass positioned to selectively strike the rotating driver mechanism for inducing a rotation of the shaft in a first direction;

a first inductor positioned to accelerate the first mass toward the rotating driver mechanism; and a first accelerator spring positioned to assist in accelerating the first mass toward the rotating driver mechanism.

5. An impact driver, comprising:

a rotatable shaft;

a rotating driver mechanism configured to rotate the shaft;

a first mass positioned to selectively strike the rotating driver mechanism for inducing a rotation of the shaft in a first direction; and a first inductor positioned to accelerate the first mass toward the rotating driver mechanism, wherein the rotating driver mechanism includes a secondary driver for selectively rotating the shaft.

6. The impact driver of claim 5, comprising a rotation detector configured to detect rotation of the shaft.

7. The impact driver of claim 6, comprising a computer configured to cause the secondary driver to rotate the shaft in response to an indication that the rotation detector detects rotation of the shaft.

8. The impact driver of claim 7, wherein the computer is configured to alternate a polarity of a signal applied to the first inductor to alternatingly accelerate the first mass toward and away from the rotating driver mechanism.

9. The impact driver of claim 5, comprising a gear selector for selectively engaging the rotating driver mechanism to the shaft, and for selectively engaging the secondary driver to the shaft, respectively.

10. The impact driver of claim 9, comprising a magnetic assembly for causing the gear selector to move between the rotating driver mechanism and the secondary driver.

11. The impact driver of claim 5, wherein the secondary driver includes a circular induction system for driving a lever that rotates the shaft.

12. The impact driver of claim 1, wherein a direction of travel of the first mass is about perpendicular to an axis of rotation of the shaft.

13. The impact driver of claim 12, wherein a travel path of the first mass is within a handle of the impact driver.

14. The impact driver of claim 1, wherein the impact driver is an impact wrench.

15. The impact driver of claim 4, comprising:

a second mass positioned to selectively strike the rotating driver mechanism for inducing a rotation of the shaft in a second direction that is opposite the first direction; and a second inductor positioned to accelerate the second mass toward the rotating driver mechanism.

16. The impact driver of claim 4, comprising a centering mechanism configured to reset the rotating driver mechanism to about a starting position after each impact of the first mass thereupon.

17. The impact driver of claim 4, wherein a direction of travel of the first mass is about perpendicular to an axis of rotation of the shaft.

18. The impact driver of claim 4, wherein the impact driver is an impact wrench.

19. The impact driver of claim 5, comprising:

a second mass positioned to selectively strike the rotating driver mechanism for inducing a rotation of the shaft in a second direction that is opposite the first direction; and a second inductor positioned to accelerate the second mass toward the rotating driver mechanism.

20. The impact driver of claim 5, comprising a centering mechanism configured to reset the rotating driver mechanism to about a starting position after each impact of the first mass thereupon.

* * * * *